United States Patent [19]

Decker

[11] Patent Number: 4,557,712

[45] Date of Patent: Dec. 10, 1985

[54] APPARATUS FOR LAYING TUBE OR WEB SECTIONS INTO A FOLDED Z-SHAPED FORM

[75] Inventor: Werner Decker, Ladbergen, Fed. Rep. of Germany

[73] Assignee: Windmoller & Holscher, Lengerich, Fed. Rep. of Germany

[21] Appl. No.: 452,951

[22] Filed: Dec. 27, 1982

[30] Foreign Application Priority Data

Dec. 28, 1981 [DE] Fed. Rep. of Germany ..... 3151568

[51] Int. Cl.[4] ..... B65H 29/46

[52] U.S. Cl. ..... 493/11; 493/22; 493/28; 493/243; 493/249; 493/405; 493/419; 493/448

[58] Field of Search ..... 493/11, 22, 28, 249, 493/413, 419–423, 436–440, 448, 356, 358, 243, 405; 156/204, 474, 353–355

[56] References Cited

U.S. PATENT DOCUMENTS 3,768,800 10/1973 Gutknecht ..... 493/413 X
3,927,875 11/1975 Winnemoller et al. ..... 493/413

FOREIGN PATENT DOCUMENTS 2244697 9/1972 Fed. Rep. of Germany .
1443339 7/1976 United Kingdom .

*Primary Examiner*—David Simmons
*Attorney, Agent, or Firm*—Fleit, Jacobson, Cohn & Price

[57] ABSTRACT

In apparatus for laying for flexible sheets into a folded Z-shaped form, a supply conveyor (1) is disposed above means (9) for supporting or transporting the leading end of each sheet (26). Clamping means (16, 17) for laterally clamping the sheet on a transverse line are provided laterally of the supporting or transporting means (9). A reciprocatable transverse rod (22) is provided in a gap between the supply conveyor (1) and the means (9). Further conveyor means at right-angles to the supporting or transporting means (9) define an inlet which consists of double belt conveyors (30) or pairs of rollers, is extensible and closable in a plier-like manner, and is arranged so that one side edge of each sheet (26) folded to Z-shape by the transverse rod (22) lies within said inlet.

10 Claims, 3 Drawing Figures

APPARATUS FOR LAYING TUBE OR WEB SECTIONS INTO A FOLDED Z-SHAPED FORM

The invention relates to an apparatus for laying tube or web sections into a folded Z-shaped form, comprising conveyor means for supplying the sections.

In an apparatus of this kind known from DE-AS No. 22 44 697, there are first conveyor means feeding at a higher speed and clamping second conveyor means which feed at a lower speed and define a draw-in gap into which there can be moved a pusher that intersects the conveying plane of the first conveyor means. To form the Z-folding in so-called insert sacks made from sections of tubular film, the loop formed between the two conveyor means is pushed to hang downwardly by means of an air jet from a blow nozzle or by means of a rod. By advancing the lower downstream direction-changing roller of the first conveyor towards the lower upstream direction-changing roller of the second conveyor, the loop is defined more positively and the pusher, which consists of a comb-like folding blade, folds the tubular web at the edge of the loop and, by way of the transverse fold, introduces the loop into a gap formed by rollers which can be moved to and fro. With the aid of this known apparatus, it is not only difficult to form a clean loop but it is also impossible properly to position the front edge of the folded section, as may be necessary in the case of further processing of the folded sections.

It is the problem of the present invention to provide an apparatus of the aforementioned kind with which it is possible to fold even large sections of comparatively thick material in an aligned manner suitable for any further processing.

According to the invention, this problem is solved in that below the supplying conveyor means there are means for supporting or transporting the advanced leading end of the section, that clamping means for laterally clamping the section tight on a transverse line are provided laterally of said supporting or transporting means, that in the gap between the supplying conveyor means and the supporting or transporting means and substantially parallel to the latter there is a reciprocatable transverse rod, and that further conveyor means at right-angles to the supporting or transporting means have an inlet which consists of double belt conveyors or pairs of rollers, is extensible and closable in a plier-like manner, and is arranged so that one side edge of the section folded to Z-shape by the transverse rod lies within same. In the apparatus according to the invention, the section to be folded can first be advanced until its leading edge lies in a position which enables positionally correct further processing of the section. After appropriate alignment of the section, the latter is laterally clamped by the clamping means to define the first fold line of the Z fold. The second fold line of the Z fold is determined by the length of the distance by which the transverse rod is first moved towards the section while taking it along with it in the form of a loop and subsequently moved beyond its front zone. As soon as the transverse rod has pulled out the desired depth of the Z fold, it is stopped and the inlet of the perpendicular conveyor means that has been opened in a plier-like manner is closed while clamping the folded section tight so that the latter is withdrawn and can be fed to other processing stations.

The apparatus of the invention is particularly applicable to the folding of tube sections for making large sacks which are shortened by the folding so that their processing at subsequent operating stations, such as during formation of the base, is simplified.

The supporting or transporting means may consist of a table or a conveyor belt. If a conveyor belt is provided, a raisable pressure roller can desirably be lowered onto the rear zone thereof as viewed in the feeding direction of the section, such a pressure roller ensuring that the leading end of the section is properly carried along.

The clamping means preferably comprise plate-shaped clamping jaws which project laterally beyond the margins of the sections and are secured to vertical supports on which there are mounted backing jaws which are movable towards the clamping jaws beneath the conveying plane of the sections. In order that the clamping means will not obstruct removal of the folded sections in the transverse direction, there could be a single plate-shaped clamping jaw acting in the manner of a folding blade.

Desirably, the clamping means are secured to the front end of the piston rod of a piston-cylinder unit disposed parallel to the feeding plane of the sections so that, by appropriately controlling same, the leading edge of the section can be aligned.

The cylinder of the piston-cylinder unit may be longitudinally displaceable on and lockable to a guide in the frame by way of a supporting member, whereby to permit the position of the first fold of the section to be altered.

In a further development of the invention, severing means are provided for severing the sections from a web which is provided with registration marks scanned by a photo-scanner, means for counting the scanned registration marks actuating the severing means after having counted a predetermined number of registration marks. In this way it is readily possible to set different lengths of sections simply by changing the counting means.

Other advantageous embodiments of the invention have been described in the subsidiary claims.

One example of the invention will now be described in more detail with reference to the drawing, wherein.

To supply the leading end of a tubular web there is a supply conveyor belt 1 of which the length is variable in a known manner not shown in greater detail so as to adapt it to different lengths of sections. In front of the supply conveyor belt 1 there are feed rollers 2, a light barrier 3 and transverse severing means 4, likewise of known construction.

Figure 1:
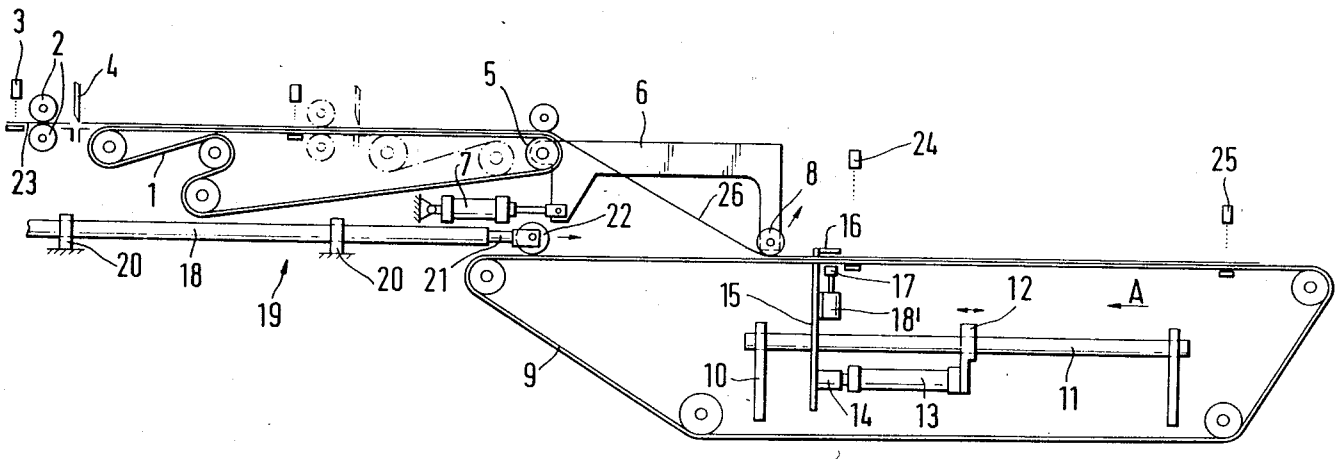
FIG. 1 is a diagrammatic side elevation of the apparatus for laying sections into a folded Z-shaped form.
Figure 2:
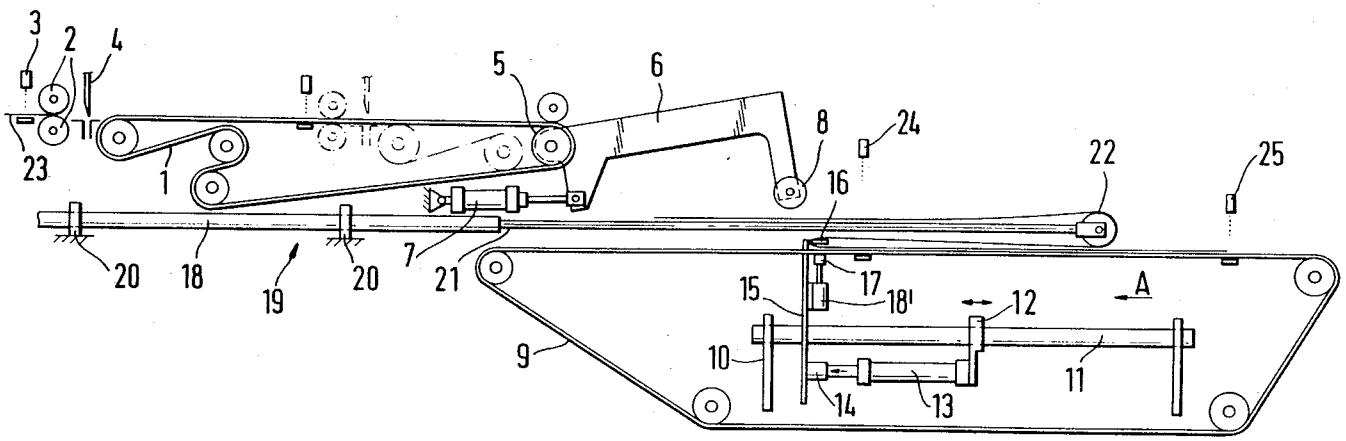
FIG. 2 shows the FIG. 1 apparatus with the folding bar projected.

The ends of the shaft of the downstream direction-changing roller 5 pivotably carry two arms 6 movable by way of a piston-cylinder unit 7. The free ends of the arms 6 carry a pressure roller 8 which can be lowered onto and raised from the upper run of a second conveyor belt 9. As shown in FIGS. 1 and 2, the second conveyor belt 9 is lower than the supply conveyor belt 1 which overlaps the conveyor belt 9 to a small extent. Fixed consoles 10 disposed between the upper and lower runs of the conveyor belt 9 carry a profile rod 11. By means of a slidable guide 12, a piston-cylinder unit 13 is displaceable on this profile rod 11, the piston rod 14 carrying a mounting 15. At the upper end of this mounting there is a collar 16 which projects over the upper run of the conveyor belt 9 from the side to a certain extent, a conveying gap remaining between the collar 16 and the upper run of the belt 9. A push member 17 which can be moved towards this collar 16 is secured to the piston rod of a further piston-cylinder unit 18' so that the upper run of the conveyor belt 9 as well as the tube section carried thereby may be clamped between the collar 16 and the push member 17. Although reference has here been made to only one clamping means, second clamping means can obviously be provided on the opposite side of the upper run.

As shown by the Figures, two piston-cylinder units 19 are juxtaposed beneath the supply conveyor belt 1, of which the cylinders 18 are carried by fixed consoles 20. The piston rods 21 of these units 19 carry a rod 22 which, on actuation of the units 19, are moved from the FIG. 1 position to that shown in FIG. 2.

The apparatus functions in the following manner:

After the tubular web 23 has been advanced by the pair 2 of feed rollers until it is disposed in the zone of a photocell 24, the pressure roller 8 descends and presses the web against the upper run of the conveyor belt 9 so that proper transport of the tubular web is also ensured by the conveyor belt 9. Such transport is continued until the light barrier 3 has counted a predetermined number of registration marks which determine the length to be severed. The severed length is slightly larger than the spacing of the severing knife 4 from the photocell 25. The need for moving beyond the photocell 25 will be explained later.

As soon as the photocell 3 has scanned the predetermined number of registration marks, the knife 4 severs a tube section 26 from the web 23. After this has occurred and the tube section 26 assumes the FIG. 1 position, the push member 17 is pressed against the collar 16 and the drive for the conveyor belt 9 is stopped. By actuating the piston-cylinder unit 13, the clamping means (collar 16 and push member 17) are thereafter moved so far in the direction of the arrow A that the leading end of the tube section 26 is engaged by the photocell 25. Such alignment of the leading edge of the tube section is necessary because the tube sections have to be fed to further processing machines, for example a sewing machine.

Figure 3:
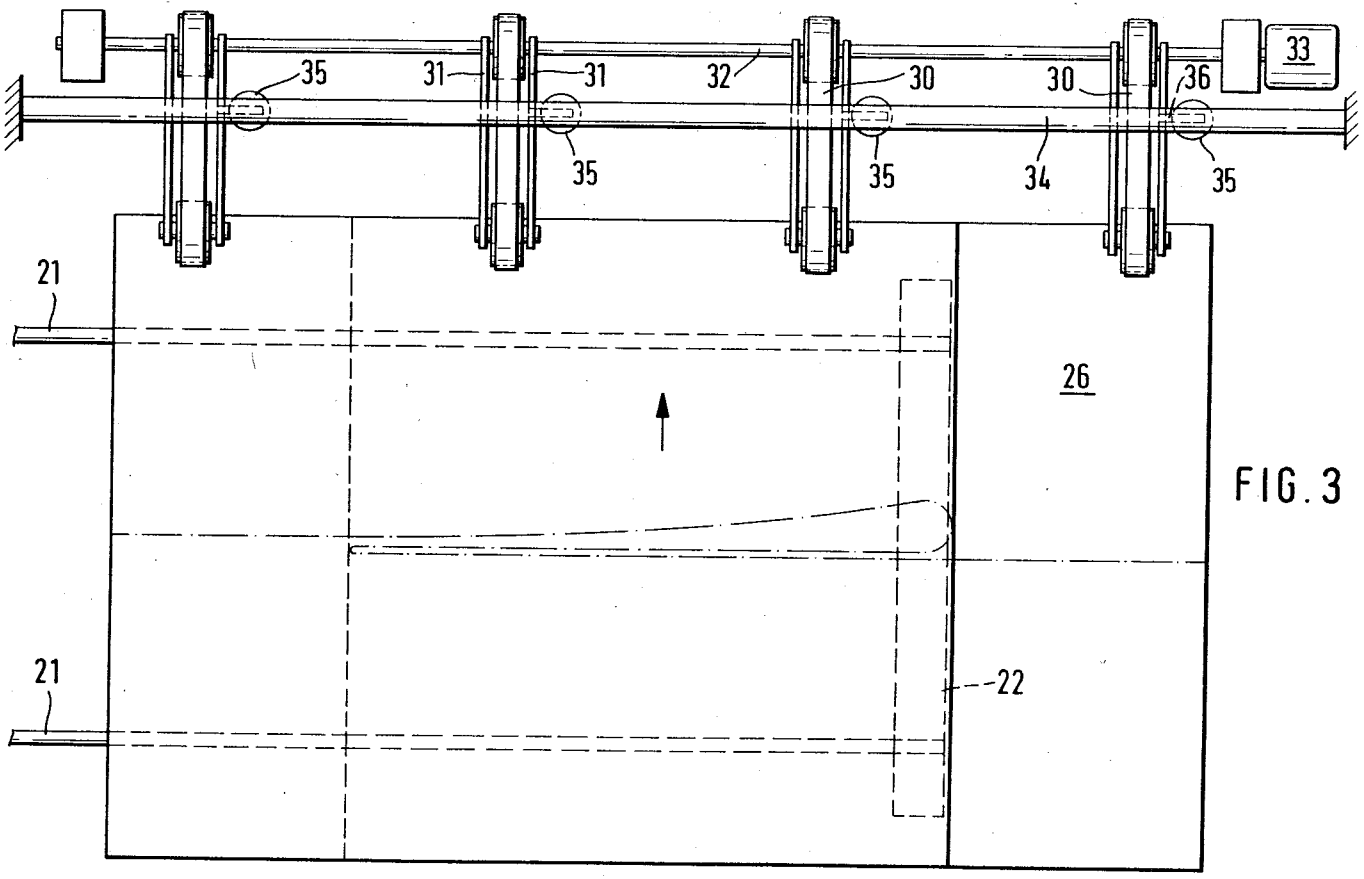
FIG. 3 is a plan view of the FIG. 2 apparatus with the transverse conveyor means for withdrawing the folded sections.

During movement of the clamping means in the direction of the arrow A, the pressure roller 8 is raised by way of the hydraulic piston-cylinder unit 7 or by way of the arms 6 and it is disposed in the FIG. 2 position. After alignment of the leading edge of the tube section 26, the piston 21 of the piston-cylinder unit 7 moves out. During such outward movement, the tube section is folded about the clamping means and at the end of the outward movement it assumes the Z-fold position shown in FIG. 2. After folding, the tube section is moved away transversely, namely by the conveyor system diagrammatically illustrated in FIG. 3. As will be seen from this Figure, four short conveyor belts 30 are freely rotatably mounted on a shaft 32 by way of arms 31, the shaft being driven by way of a motor 33. A cross-member 34 disposed above the conveyor belts 30 comprises four piston-cylinder units 35 of which the piston rods are connected by way of holders 36 to the arms 31 so that the conveyor belts 30 can be raised and lowered by the piston-cylinder units 35, namely independently of each other to compensate for different thicknesses of sacks caused by the folding. These conveyor belts 30 are thus lowered onto the folded tube section 26 from above as is shown in FIG. 3 and they press same against four further conveyor belts (not shown) disposed below the conveyor belts 30. By switching on the motor 33, the tube section 26 is then taken away transversely whilst the rod 22 which effected the folding still remains in its FIG. 2 position.

The sack section to be taken away is shown in chain-dotted lines turned through 90° in FIG. 3 in the folded tube section 26. After removal of the folded tube section 36, the feed roller pair 2 is then started and the tubular web 23 is advanced. The previously described process is then repeated in an analogous manner.

I claim:

1. Apparatus for laying tube or web sections into a folded Z-shaped form, comprising conveyor means for supplying the sections, characterised in that below the supplying conveyor means (1) there are means (9) for supporting or transporting the advanced leading end of the section (26), that clamping means (16, 17) for laterally clamping the section (26) tight on a transverse line are provided laterally of said supporting or transporting means (9), that in the gap between the supplying conveyor means (1) and the supporting or transporting means (9) and substantially parallel to the latter there is a reciprocatable transverse rod (22), and that further conveyor means at right-angles to the supporting or transporting means (9) have an inlet which consists of double belt conveyors (30) or pairs or rollers, is extensible and closable in a plier-like manner, and is arranged so that one side edge of the section (26) folded to Z shape by the transverse rod (22) lies within same.

2. Apparatus according to claim 1, characterised in that the transporting means comprise a conveyor belt (9) onto the rear zone of which, as viewed in the feeding direction of the section (26), a raisable pressure roller (8) can be lowered.

3. Apparatus according to claim 2, characterised in that the pressure roller (8) is mounted at the front end of a lever or pair of levers (6) which can be pivoted by a piston-cylinder unit (7).

4. Apparatus according to claim 1, characterised in that the clamping means comprise plate-shaped clamping jaws (16) which project laterally beyond the margins of the sections (26) and are secured to vertical supports (15) on which there are mounted backing jaws (17) which are movable towards the clamping jaws (16) beneath the conveying plane of the sections (26).

5. Apparatus according to claim 4, characterised in that the vertical supports (15) are secured to the front end of the piston rod (14) of a piston-cylinder unit (13) disposed parallel to the feeding plane of the sections (26).

6. Apparatus according to claim 5, characterised in that the cylinder of the piston-cylinder unit (13) is longitudinally displaceable on and lockable to a guide in the frame by way of a supporting member (12).

7. Apparatus according to claim 1, characterised in that severing means (4) are provided for severing the sections from a web (23) which is provided with registration marks scanned by a photoscanner, and that means for counting the scanned registration marks actuate the severing means (4) after having counted a predetermined number of registration marks.

8. Apparatus according to claim 1, characterised in that a photoscanner (25) or the like for aligning the front edge of the section (26) controls the piston-cylinder unit (13) moving the clamping jaws (16, 17).

9. Apparatus according to claim 1, characterised in that the transverse rod (22) is mounted on the piston rod of a piston-cylinder unit (18).

10. Apparatus according to claim 1, characterised in that the inlet comprises a plurality of short parallel double-belt conveyors (30) of which the upper belts are separately pivotable by piston-cylinder units (35).

* * * * *